US006780479B2

(12) United States Patent
Katsuoka et al.

(10) Patent No.: US 6,780,479 B2
(45) Date of Patent: Aug. 24, 2004

(54) HOT-MELT TRANSFER INK IMAGE-RECEIVING SHEET

(75) Inventors: Toshimichi Katsuoka, Tokyo (JP); Hironori Sato, Saitama (JP); Junichi Nouda, Tokyo (JP)

(73) Assignee: Kimoto Co., Ltd. (JP)

( * ) Notice: Subject to any disclaimer, the term of this patent is extended or adjusted under 35 U.S.C. 154(b) by 93 days.

(21) Appl. No.: 10/079,880

(22) Filed: Feb. 22, 2002

(65) Prior Publication Data

US 2002/0164461 A1 Nov. 7, 2002

(30) Foreign Application Priority Data

Feb. 26, 2001 (JP) ..... 2001-049662

(51) Int. Cl.[7] ..... B41M 5/30
(52) U.S. Cl. ..... 428/32.39; 428/32.51
(58) Field of Search ..... 428/32.39, 32.51, 428/32.5, 32.52

(56) References Cited

U.S. PATENT DOCUMENTS 6,277,785 B1 * 8/2001 Narita et al. ..... 503/227
6,326,055 B1 * 12/2001 Arai et al. ..... 427/195

* cited by examiner

*Primary Examiner*—Bruce Hess
(74) *Attorney, Agent, or Firm*—Lorusso, Loud & Kelly

(57) ABSTRACT

There is provided a hot-melt transfer ink image-receiving sheet which is excellent in abrasion resistance as well as image density and halftone dot reproducibility of a recorded image and useful as a contact printing film in the photomechanical process. In this hot-melt transfer ink image-receiving sheet 4 having an image-receiving surface 3 on a support 1, the image-receiving surface 3 has surface roughness (JIS-B0601) of 0.15–0.60 μm in terms of arithmetic mean deviation Ra and 1.0–3.0 μm in terms of 10-point height of irregularities Rz.

16 Claims, 1 Drawing Sheet

HOT-MELT TRANSFER INK IMAGE-RECEIVING SHEET

BACKGROUND OF THE INVENTION

The present invention relates to a hot-melt transfer ink image-receiving sheet that has excellent abrasion resistance, is useful as a contact printing film using a photomechanical process and achieves excellent image density and halftone dot reproducibility in a recorded image.

Thermographic recording methods, which do not require post-processing such as development and fixation unlike the silver salt photographic recording method and the electrophotographic recording method, have been employed as a method for making various hard copies which does not produce processing wastes. The thermographic recording methods include a direct thermographic method, wherein a thermal color developing layer obtained by dispersing a color precursor, color developer, sensitizer and so forth in a binder resin is provided on an image-receiving sheet and the thermal color developing layer is heated to develop color, and a hot-melt transfer method, wherein a hot-melt transfer ink layer of an ink ribbon is transferred on an image-receiving sheet.

When a contact printing film using a photomechanical process is prepared by the direct thermographic method, small characters and minute halftone dots can be reproduced and hence a high-resolution image can be obtained. However, image density enough to print a photographic material cannot be obtained, and thus there was a difficulty to use this method in practice.

On the other hand, when a contact printing film in the photomechanical process is prepared by the hot-melt transfer method, image density enough to print a photographic material can be obtained when high light-shielding property is imparted by making a hot-melt transfer ink layer of the ink ribbon thick. However, when an ink ribbon having a thick hot-melt transfer ink layer is used to record an image on a conventional known image-receiving sheet such as a transparent plastic film, small characters and minute halftone dots cannot be reproduced due to insufficient fixation property of the transferred image on an image-receiving sheet and ununiform transfer.

In order to solve these problems, an ink ribbon which has a thin hot-melt transfer ink layer and high light-shielding property needs to be used. However, when an image is recorded on a conventional known image-receiving sheet such as a transparent plastic film, the transferred image could not be imparted with sufficient image density and abrasion resistance.

In order to impart abrasion resistance to an image, a method is considered wherein the image-receiving surface of the hot-melt transfer ink image-receiving sheet is roughened so that hot-melt transfer ink should be buried in the image-receiving sheet to improve fixation property for the ink. However, while the abrasion resistance is improved when the image-receiving surface is roughened, protruding portions of the image-receiving surface penetrate the hot-melt transfer ink, which results in occurrence of pinholes. The occurrence of pinholes degrades image density and prevents formation of high-quality halftone dots and thus a problem arises that reproducibility of halftone dots is degraded in the photomechanical process. This problem is particularly noticeable when an ink ribbon which has a thin ink layer and high light-shielding property is used to reproduce minute halftone dots as described above.

On the other hand, occurrence of pinholes can be prevented by reducing the roughness of the image-receiving surface. However, this results in insufficient fixation property for the hot-melt transfer ink and thereby degrades abrasion resistance of an image. Further, in this case, a so-called reverse transfer, wherein an image transferred onto the image-receiving surface is reversely transferred to an overlapped ink ribbon, occurs and hence a part of the image is deleted. Thus, the halftone dot reproducibility is further degraded.

Accordingly, an object of the present invention is to provide a hot-melt transfer ink image-receiving sheet that is excellent in image abrasion resistance as well as halftone dot reproducibility and image density even when an ink ribbon having a thin hot-melt transfer ink layer is used, and is useful as a contact printing film in a photomechanical process.

SUMMARY OF THE INVENTION

The inventors of the present invention have found that, while image abrasion resistance correlates with arithmetic mean deviation Ra of surface roughness (JIS-B0601), the levels of the image density and halftone dot reproducibility, while not necessarily reflected in arithmetic mean deviation Ra, correlate with 10-point height of irregularities Rz. They further found that excellent abrasion resistance as well as favorable image density and halftone dot reproducibility could be obtained by defining both Ra and Rz within predetermined ranges.

Specifically, the hot-melt transfer ink image-receiving sheet of the present invention is a hot-melt transfer ink image-receiving sheet having an image-receiving surface on a support, wherein the image-receiving surface has surface roughness (JIS-B0601) of 0.15–0.60 $\mu$m in terms of arithmetic mean deviation Ra and 1.0–2.5 $\mu$m in terms of 10-point height of irregularities Rz.

Preferably, the image-receiving surface consists of an overcoat layer containing an emulsion resin of which glass transfer temperature is 50–120° C. Examples of the emulsion resin include a homopolymer and copolymer of monomer selected from ethylene, styrene, vinyl chloride, vinyl acetate, acrylonitrile, methyl methacrylate.

The hot-melt transfer ink image-receiving sheet of the present invention may have an image-receptive layer comprising a binder resin and a surface-roughening agent formed on the support. Preferably, the surface-roughening agent is amorphous silica and has an average particle diameter in the range of 1.0–5.0 $\mu$m.

It is also preferable that the hot-melt transfer ink image-receiving sheet has ultraviolet ray transimissivity of lower than 0.3 in terms of ultraviolet ray transmission density.

PREFERRED EMBODIMENT OF THE INVENTION

Figure 1:
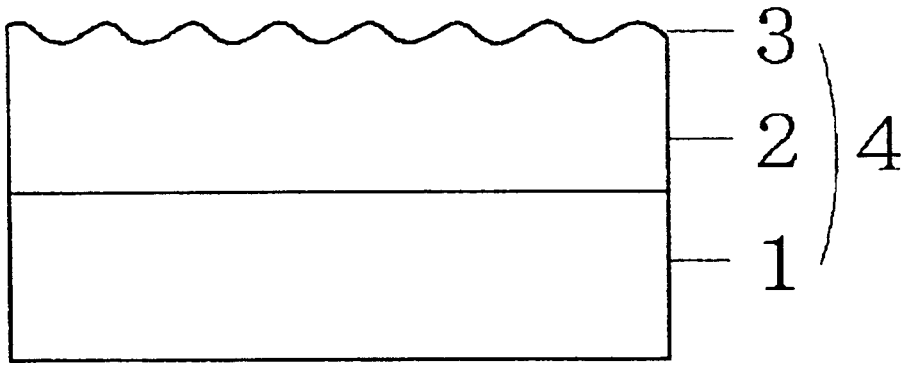
FIG. 1 is a cross sectional view showing an embodiment of a hot-melt transfer ink image-receiving sheet according to the present invention.

The hot-melt transfer ink image-receiving sheet of the present invention (hereinafter, may also be referred to as "image-receiving sheet") is an image-receiving sheet having an image-receiving surface on a support, wherein the image-receiving surface has surface roughness (JIS-B0601) of 0.15–0.60 $\mu$m in terms of arithmetic mean deviation Ra and 1.0–2.5 $\mu$m in terms of 10-point height of irregularities Rz. Hereafter, each components of a preferred embodiment will be explained.

FIG. 1 shows one embodiment of a hot-melt transfer ink image-receiving sheet 4 of the present invention. This image-receiving sheet 4 consists of a support 1, image-receptive layer 2 and image-receiving surface 3, and has ultraviolet ray transmissivity as a whole. The image-receiving sheet 4 as a whole preferably has ultraviolet ray transmissivity of lower than 0.3 in terms of ultraviolet ray transmission density. Favorable ultraviolet ray transmissivity can be achieved in non-image portions by making the ultraviolet ray transmission density lower than 0.3, and thus no problem arises during the photomechanical process.

A usable support may be a transparent plastic film such as polyethylene, polypropylene, polyvinyl chloride, polystyrene, polycarbonate or polyester. Further, two or more of these films may be laminated. Among these, a polyester film is preferred because of its excellent mechanical strength, dimensional stability, resistance to chemicals, waterproof property and ultraviolet ray transmissivity.

The thickness of a support is not particularly limited, but a thickness of 30–200 $\mu$m is preferred in view of use as a contact printing film in the photomechanical process, traveling performance in a hot-melt transfer printer, easiness of the ink transfer from an ink ribbon and so forth.

When an image-receptive layer described later is formed on a support, it is preferable to provide an easy adhesion layer on the support or subject the support to a plasma treatment, corona discharge treatment, far infrared radiation or the like in order to achieve favorable adhesion.

The image-receiving surface preferably has surface roughness (JIS-B0601) of 0.15–0.60 $\mu$m, preferably 0.20–0.50 $\mu$m in terms of arithmetic mean deviation Ra. When the arithmetic mean deviation Ra is made 0.15 $\mu$m or higher, the fixation property of hot-melt transfer ink (hereinafter, may also be referred to as "ink") to the image-receiving surface can be improved and hence sufficient abrasion resistance can be imparted to a recorded image. Further, when an image-receiving sheet on which an image is already recorded is used as a contact printing film in the photomechanical process, performances in vacuum contact and separation can be improved, thereby resulting in improved workability. When the arithmetic mean deviation Ra is made 0.60 $\mu$m or lower, ink of ink ribbon can be transferred into valleys (depressed portions) of the image-receiving surface. Therefore, ink of ink ribbon can be transferred according to the shape of the image-receiving surface from peaks (protruding portions) to valleys (depression portions), thereby resulting in sufficient ink fixation property.

Further, the image-receiving surface preferably has surface roughness of 1.0–2.5 $\mu$m, preferably 1.2–2.3 $\mu$m in terms of 10-point height of irregularities Rz. When the 10-point height of irregularities Rz is made 1.0 $\mu$m or higher, sufficient ink fixation property can be obtained. As a result, so-called reverse transfer, where an image transferred on the image-receiving surface is reversely transferred to an ink ribbon which is overlapped, is prevented, and hence no part of the image is omitted. Thus favorable halftone dot reproducibility and image density can be obtained. When the 10-point height of irregularities Rz is made 2.5 $\mu$m or lower, occurrence of pinholes in solid image portions can be prevented, and hence favorable image density and halftone dot reproducibility can be obtained. The surface roughness of the image-receptive layer is limited by 10-point height of irregularities Rz because, when only the arithmetic mean deviation Ra is defined within a predetermined value, peaks (protruding portions) significantly higher than the defined Ra value may be included if the integrated area is small. In this case, when ink of an ink layer is transferred to such peaks (protruding portions), peaks (protruding portions) penetrate the ink layer and the ink is not transferred to the corresponding portions (pinholes occur), which results in degraded image density and halftone dot reproducibility. On the other hand, since definition of 10-point height of irregularities Rz prevents peaks extremely higher than the Rz value from being included, favorable image density and halftone dot reproducibility can be achieved when this value is defined within an appropriate range.

Here, the arithmetical mean deviation Ra means a value obtained as a uniform height of peaks and valleys existing on a surface roughness curve of an evaluation length, which is obtained by dividing an integral of the absolute values of the peak heights and valley depth by the evaluation length. The 10-point height of irregularities Rz is obtained as follows. That is, a surface roughness curve of an evaluation length, which is N times long as a sampling length equal to a cutoff value, is divided into N of equal sections. For each section, Rz' is obtained as a difference of an average height of peaks having heights of the highest to the fifth highest and an average depth of valleys having depths of the deepest to the fifth deepest. The 10-point height of irregularities Rz is obtained as an arithmetic average of N of Rz'.

Methods for obtaining an image-receiving surface in such a shape are not particularly limited. For example, there can be mentioned a surface coating method, wherein a coating solution for an image-receptive layer containing a binder resin and a surface-roughening agent are applied to a support and dried to form an image-receptive layer. In addition to this method, there can be mentioned a sand blasting method, wherein a support surface is sprayed with fine silica sands at high speed, a chemical etching method, wherein a support surface is dipped in a chemical agent, and so forth. This image-receiving surface is provided on one side or both sides of the support. Among the aforementioned methods, the surface coating method is most preferred.

A binder resin constituting an image-receptive layer may be a known polymer resin. Examples thereof include organic solvent soluble resins such as polyvinyl acetate, vinyl acetate/(meth)acrylic ester copolymer, methyl methacrylate/(meth)acrylic ester copolymer, vinyl chloride/vinyl acetate copolymer, vinylidene chloride/vinyl chloride copolymer, polyurethane, polyvinyl butyral, cellulose nitrate, cellulose acetate and polyester, water soluble resins such as gelatin, hydroxy ethyl cellulose, poly(methyl ether), polyvinylpyrrolidone, polyvinyl alcohol and water soluble nylon and so forth. When a water soluble resin is used, a known waterproofing agent such as glyoxal, urea formalin resin or trimethylolmelamine resin and an emulsified organic solvent soluble resin are preferably used in combination therewith to improve waterproof property and image fixation property of the image-receiving surface. Among these binder resins, (meth)acrylic ester copolymer, methyl methacrylate/(meth)acrylic ester copolymer, polyvinyl butyral and polyester, which have excellent fixation property for hot-melt transfer ink, are preferred.

Examples of a surface-roughening agent contained in the image-receptive layer include fine powder of known inorganic materials and organic materials. Examples of the fine inorganic powder include that of calcium carbonate, calcium silicate, magnesium silicate, silica, barium sulfate, zinc oxide, titanium oxide, clay, alumina and so forth. Examples of the fine organic powder include that of acrylic resins, epoxy resins, silicon resins, nylon resins, polyethylene resins, benzoguanamine resins and so forth. The surface-roughening agent can be used solely or in combination of two or more kinds. Among the surface-roughening agents, silica, particularly amorphous silica is preferred in view of dispersing property of the surface-roughening agent when an image-receptive layer coating solution is prepared and ultraviolet ray transmissivity.

The surface-roughening agent preferably has an average particle diameter in the range of 1.0–5.0 μm, preferably 2.0–4.0 μm. Those having a narrow particle diameter distribution are preferred. If the average particle diameter exceeds 5.0 μm or if the particle diameter distribution is broad and particles having a large particle diameter are contained even though the average particle diameter is small, the 10-point height of irregularities Rz exceeds 2.5 μm, and hence favorable image density and halftone dot reproducibility cannot be obtained. Further, if the average particle diameter is less than 1.0 μm, most particles are buried in a resin binder constituting a image-receptive layer, and hence a rough surface cannot be formed. Thus, sufficient ink fixation property cannot be obtained.

In order to achieve predetermined surface roughness, the amount of the surface-roughening agent to be added is preferably in the range of 5–100 parts by weight per 100 parts by weight of a binder resin, more preferably in the range of 10–60 parts by weight. When the amount of the surface-roughening agent to be added is made 5 parts by weight or more per 100 parts by weight of the binder resin, the image-receptive layer can be imparted with ink fixation property. When the amount is made 100 parts by weight or less, the ultraviolet ray transmission density of an image-receiving sheet can be made lower than 0.3, resulting in favorable ultraviolet ray transmissivity during printing in the photomechanical process.

Besides the binder resins and surface-roughening agents mentioned above, electric conduction agents, colorants, thixotropy imparting agents, leveling agents or the like can be added to the image-receptive layer as long as the aforementioned properties are not degraded.

The thickness of the image-receptive layer is not particularly limited, but is preferably in the range of 1–10 μm, more preferably 3–7 μm. When the thickness is made 1 μm or larger, image fixation property can be imparted. When the thickness is made 10 μm or smaller, flexibility of the image-receptive layer can be maintained and favorable ultraviolet ray transmissivity can be achieved during the printing in the photomechanical process.

When an image-receiving surface is prepared by a surface coating method, an image-receptive layer coating solution composed of a surface-roughening agent, a binder resin and so forth to constitute the image-receptive layer is dispersed and prepared by using a known dispersing means such as, for example, a ball mill, sand grinder, attriter, roll mill, high speed impeller or disperser. The dispersed and prepared image-receptive layer coating solution is applied to a support and dried by a known coating method such as roll coating, bar coating or blade coating to form an image-receptive layer, and thus a roughened image-receiving surface can be obtained.

As a preferred embodiment of the present invention, the image-receiving sheet preferably has an overcoat layer containing an emulsion resin on a surface thereof. Examples of the emulsion resin include homopolymers or copolymers of a monomer selected from ethylene, styrene, vinyl chloride, vinyl acetate, acrylonitrile, methyl methacrylate and so forth. Specifically, there can be mentioned emulsions such as methyl methacrylate polymer, ethylene/vinyl acetate copolymer, ethylene/methyl methacrylate copolymer and acryl/styrene copolymer. By containing such an emulsion resin, reverse transfer can be effectively prevented, and image density and halftone dot reproducibility can be improved. Among these emulsion resins, those of which glass transfer temperature is 50–120° C. are preferred since they can prevent excessive ink transfer from ink ribbon, which results in swollen halftone dots, and thereby improve halftone dot reproducibility.

The thickness of the overcoat layer is preferably in a range of 0.05–0.5μm not to degrade the surface roughness of the image-receiving suface.

In order to obtain favorable property for the image-receiving sheet to be discharged from a hot-melt transfer printer, it is preferable that an antistatic agent is contained in the aforementioned image-receptive layer or overcoat layer or that an antistatic layer is provided on the front side of the image-receiving sheet as long as the aforementioned performances are not degraded. The surface resistivity (JIS-K6900) of the image-receiving sheet is preferably $10^7$–$10^{10}$ Ω under conditions at a temperature of 20° C. and RH of 65%. As an antistatic agent, a known antistatic agent such as quaternary ammonium salt can be used.

Next, a hot-melt transfer printer and an ink ribbon suitable for the image-receiving sheet of the present invention will be explained.

A hot-melt transfer printer such as a direct thermal printer can be used to transfer hot-melt ink to the image-receiving sheet of the present invention. A usable direct thermal printer may be of either type of a line printer equipped with a line-type thermal head made of a thick film or thin film or a serial printer equipped with a serial type thermal head made of a thin film. The recording energy density of the thermal head is preferably 10–100 mJ/mm$^2$. In order to obtain highly defined halftone dots, the image recording density of the thermal head is preferably 16 dots/mm$^2$ or higher.

The ink ribbon used for a hot-melt transfer printer is obtained by providing a hot-melt transfer ink layer (hereinafter, may also be referred to as "ink layer") on a support made of a polyester film having a thickness of 2–6 μm or the like. The ink layer is made of a wax of which melting point is 60–120° C. such as a paraffin wax, micro wax, polyethylene wax, carnauba wax, candelilla wax, montan wax and lanoline wax, a binder resin of which softening point is 60–200° C. such as a polyester resin, acrylic resin, urethane resin, ethylene vinyl acetate resin, amide resin and polyterpine resin, a color pigment such as carbon black, azo pigment, phthalocyanine pigment, quinacridone pigment, thioindigo pigment or isoindolin pigment and so forth.

The ink ribbon preferably has an ink layer having a thickness of 0.5–4.0 μm and light-shielding property of 3.0 or higher in terms of ultraviolet ray transmission density. More preferred ink ribbon has an ink layer having a thickness of 1.5–2.5 μm and light-shielding property of 4.0 or higher in terms of ultraviolet ray transmission density, by which favorable halftone dot reproducibility and image density enough to print a photographic material can be obtained. The hue of the ink ribbon is not particularly limited so far as ultraviolet ray shielding property enough to print a photographic material can be obtained. However, red, brown, green and black are preferred since an image can be easily confirmed by visual observation.

As described above, since the image-receiving sheet of the present invention has arithmetic mean deviation Ra and 10-point height of irregularities Rz defined within a certain range, image abrasion resistance is excellent, no pinhole or reverse transfer occurs, and excellent reproducibility of small characters and minute halftone dots can be achieved without degrading image density even if a thin film ink ribbon is used for the ink layer. Therefore, the image-receiving sheet can be used as a contact printing film using the photomechanical process such as offset PS plate making, photosensitive silk plate making, photosensitive flexographic plate making, dry film printing for metal etching and photosensitive resist ink printing. In particular, this image-receiving sheet is preferably used as a contact printing film in the offset PS plate making because of its excellent halftone dot reproducibility and image density.

EXAMPLES

Hereafter, the present invention will be explained with reference to examples. In the following examples, "part" and "%" are used on a weight basis unless otherwise indicated.

Example 1

The following image-receptive layer coating solution was applied to a polyester film (COSMO SHINE A4300: Toyobo Co., Ltd.) having a thickness of 75 μm of which surface is subjected to easy adhesion treatment, and dried to form an image-receptive layer having a thickness of 5 μm, and thus an image-receiving sheet was obtained.

<Coating Solution for Image-Receptive Layer>

| | |
|---|---|
| Polyester resin solution (solid content: 40%) (VYRON GK810: Toyobo Co., Ltd.) | 50 parts |
| Fine silica powder (average particle diameter: 3.0 μm) (SYLYSIA 730: Fuji Silysia Chemical Co., Ltd.) | 5 parts |
| Ultrafine silica powder (average particle diameter: 16 nm) (Aerosil R972: Nippon Aerosil Co., Ltd.) | 1 part |
| Toluene | 44 parts |
| Cyclohexanone | 15 parts |
| Butyl acetate | 15 parts |
| Silicon oil (Paintad M: Dow Corning Toray Silicone Co., Ltd.) | 0.1 parts |

The above mixture was dispersed by using a paint shaker for 120 minutes to obtain a coating solution.

Example 2

The following overcoat layer coating solution was applied to the image-receptive layer of the image-receiving sheet obtained in Example 1 and dried to form an overcoat layer having a thickness of 0.1 μm, and thus an image-receiving sheet was obtained.

<Coating Solution for Overcoat Layer>

| | |
|---|---|
| Emulsion resin (glass transfer temperature: 108° C.) (Aquatex ES-90: Chuo Rika Kogyo Corporation) | 10 parts |
| Sulfonated polystyrene ammonium salt (VERSA-TL125: Kanebo NSC) | 2 parts |
| Ethyl alcohol | 30 parts |
| Water | 58 parts |

Comparative Example 1

The following image-receptive layer coating solution was applied to a polyester film (COSMO SHINE A4300: Toyobo Co., Ltd.) having a thickness of 75 μm of which surface is subjected to easy adhesion treatment and dried to form an image-receptive layer having a thickness of 5 μm, and thus an image-receiving sheet was obtained.

<Coating Solution for Image-Receptive Layer>

| | |
|---|---|
| Polyester resin solution (solid content: 40%) (VYRON GK810: Toyobo Co., Ltd.) | 50 parts |
| Ultrafine silica powder (average particle diameter: 16 nm) (Aerosil R972: Nippon Aerosil Co., Ltd.) | 1 part |
| Toluene | 44 parts |
| Cyclohexanone | 15 parts |
| Butyl acetate | 15 parts |
| Silicon oil (Paintad M: Dow Corning Toray Silicone Co., Ltd.) | 0.1 parts |

Comparative Example 2

The following image-receptive layer coating solution was applied to a polyester film (COSMO SHINE A4300: Toyobo Co., Ltd.) having a thickness of 75 μm of which surface is subjected to easy adhesion treatment and dried to form an image-receptive layer having a thickness of 5 μm, and thus an image-receiving sheet was obtained.

<Coating Solution for Image-Receptive Layer>

| | |
|---|---|
| Pester resin solution (solid content: 40%) (VYRON GK810: Toyobo Co., Ltd.) | 50 parts |
| Fine silica powder (average particle diameter: 6.0 μm) (SILYSIA770: Fuji Silysia Chemical Co., Ltd.) | 4 parts |
| Ultrafine silica powder (average particle diameter: 16 nm) (Aerosil R972: Nippon Aerosil Co., Ltd.) | 1 part |
| Toluene | 44 parts |
| Cyclohexanone | 15 parts |
| Butyl acetate | 15 parts |
| Silicon oil (Paintad M: Dow Corning Toray Silicone Co., Ltd.) | 0.1 parts |

The above mixture was dispersed by using a paint shaker for 60 minutes to obtain a coating solution.

The surface roughness (arithmetic mean deviation Ra, 10-point height of irregularities Rz) of the image-receiving surface was measured for the image-receiving sheets obtained in Examples 1 and 2 and Comparative Examples 1 and 2 in accordance with JIS-B0601. The results are shown in Table 1.

TABLE 1

| | Arithmetic mean deviation | 10-point height of irregularities |
|---|---|---|
| Example 1 | 0.48 | 2.3 |
| Example 2 | 0.41 | 2.1 |
| Comparative Example 1 | 0.11 | 0.7 |
| Comparative Example 2 | 0.51 | 2.9 |

After screen tint halftone dots (80 lines, area ratio: 5–100%) were transferred by using a hot-melt transfer printer (Kimosetter 340: Kimoto Co., Ltd.), the following items were evaluated for the image-receiving sheets obtained in Examples 1 and 2 and Comparative Examples 1 and 2. The results are shown in Table 2.

An ink ribbon with an ink layer having a thickness of 2.0 μm and ultraviolet ray transmission density of 4.0 was used.

(1) Abrasion Resistance

A halftone black solid portion was scratched by using a surface measuring instrument (Heidon-14: Shinto Scientific), and then the abrasion resistance was evaluated by the minimum load for generating an abrasion, which is a linear white omission. A sapphire needle having a diameter of 0.1 mm was used for the measurement. The scratching speed was 200 mm/minute. As a result, "o" was given when the minimum load was 80 g or more, and "x" was given when the minimum load was less than 80 g.

(2) Pinholes

Halftone black solid portions were visually observed on a high brightness light table using a 50:1 magnifier. As a result, "o" was given when few pinholes were observed, and "x" was given when many pinholes were observed.

(3) Reverse Transfer

Halftone screen tint portions with an area ratio of 10–40% were examined to see whether there was any omission in a horizontal line in halftone dots. As a result, "o" was given when there was no omission. " was given when there were a few omissions. "x" was given when there were omissions.

(4) Transmission Density

The ultraviolet ray transmission density of non-image portions of halftone dot was measured by using a transmission densitometer (TD-904: Macbeth). An ultraviolet ray filter was used, and the measuring aperture size was 2 mm. As a result, "o" was given when the transmission density was lower than 0.3. "x" was given when the transmission density was 0.3 or higher.

(5) Image Density

The ultraviolet ray transmission density of black solid portions of halftone dot was measured by using a transmission densitometer (TD-904: Macbeth). An ultraviolet ray filter was used and the measuring aperture size was 2 mm. As a result, "o" was given when the transmission density was 2.8 or higher. "x" was given when the transmission density was lower than 2.8.

TABLE 2

| | Abrasion resistance | Pinholes | Reverse transfer | Transmission density | Image density |
|---|---|---|---|---|---|
| Example 1 | ○ | ○ | Δ | ○ | ○ |
| Example 2 | ○ | ○ | ○ | ○ | ○ |
| Comparative Example 1 | x | ○ | x | ○ | ○ |
| Comparative Example 2 | ○ | x | Δ | ○ | x |

The image-receiving sheet of Example 1 had an image-receiving surface having surface roughness of 0.15–0.60 μm in terms of arithmetic mean deviation Ra and 1.0–2.5 μm in terms of 10-point height of irregularities Rz. Therefore, abrasion resistance, pinhole occurrence prevention, reverse transfer prevention, image density and so forth thereof were satisfactory.

The image-receiving sheet of Example 2 was obtained by providing the image-receiving sheet of Example 1 with an overcoat layer containing an emulsion resin of which glass transfer temperature was 50–120° C. Therefore, abrasion resistance, pinhole occurrence prevention, image density and so forth were satisfactory, and the reverse transfer prevention was even better than that of the image-receiving sheet of Example 1.

The image-receiving sheet of Comparative Example 1 had an image-receiving surface having surface roughness of less than 0.15 μm in terms of arithmetic mean deviation Ra. Therefore, abrasion resistance and reverse transfer prevention of an image were poor.

The image-receiving sheet of Comparative Example 2 had an image-receiving surface having surface roughness in the range of 0.15–0.60 μm in terms of arithmetic mean deviation Ra, but its 10-point height of irregularities Rz was not in the range of 1.0–2.5 μm. Therefore, pinholes occurred in the image, and hence the image density was not sufficient.

As described above, since the hot-melt transfer ink image-receiving sheet of the present invention has an image-receiving surface with surface roughness defined in a certain range, this sheet is not only excellent in image abrasion resistance, but also occurrence of pinholes and reverse transfer can be prevented. Therefore, image density is not lowered, and excellent halftone dots can be formed. Thus, the hot-melt transfer ink image-receiving sheet of the present invention is preferred as a contact printing film in the photomechanical process because of its excellence in image density and halftone dot reproducibility.

What is claimed is:

1. A hot-melt transfer ink image-receiving sheet for use as a printing film in a photomechanical process, said sheet having an ultraviolet ray transmission density of less than 0.3, and said sheet comprising a support and an image-receiving surface on the support, wherein the image-receiving surface has surface roughness (JIS-B0601) of 0.15–0.60 μm in terms of arithmetic mean deviation Ra and 1.0–2.5 μm in terms of 10-point height of irregularities Rz.

2. The hot-melt transfer ink image-receiving sheet according to claim 1, wherein the image-receiving surface is provided by an overcoat layer formed on the support and containing an emulsion resin having a glass transfer temperature of is 50–120° C.

3. The hot-melt transfer ink image-receiving sheet according to claim 2, wherein the emulsion resin consists of a homopolymer or copolymer of a monomer selected from the group consisting of ethylene, styrene, vinyl chloride, vinyl acetate, acrylonitrile and methyl methacrylate.

4. The hot-melt transfer ink image-receiving sheet according to claim 2, wherein the thickness of the overcoat layer is in the range of 0.05–0.5 μm.

5. The hot-melt transfer ink image-receiving sheet according to claim 2 wherein the support is a transparent plastic film.

6. the hot-melt transfer ink receiving sheet according to claim 5, wherein the transparent plastic film is formed of a plastic selected from the group consisting of polypropylene, polyvinyl chloride, polystyrene, polycarbonate and polyester.

7. The hot-melt transfer ink image-receiving sheet according to claim 1, wherein the sheet comprises an image-receptive layer comprising a binder resin and a surface-roughening agent formed on the support to provide the image-receiving surface.

8. The hot-melt transfer ink image-receiving sheet according to claim 7, wherein the surface-roughening agent has an average particle diameter in the range of 1.0–5.0 μm.

9. The hot-melt transfer ink image-receiving sheet according to claim 8, wherein the surface-roughening agent is amorphous silica.

10. The hot-melt transfer ink image-receiving sheet according to claim 1 wherein the image-receiving surface is formed by coating an image-receptive layer on the support.

11. The hot-melt transfer ink image-receiving sheet according to claim 1 wherein the support is a transparent plastic film.

12. The hot-melt transfer ink receiving sheet according to claim 11 wherein the transparent plastic film is formed of a plastic selected from the group consisting of polypropylene, polyvinyl chloride, polystyrene, polycarbonate and polyester.

13. The hot-melt transfer ink receiving sheet according to claim 11 wherein the transparent plastic film is formed of a plastic selected from the group consisting of polypropylene, polyvinyl chloride, polystyrene, polycarbonate and polyester.

14. A hot-melt transfer ink image-receiving sheet for use as a printing film in a photomechanical process, said sheet comprising a transparent plastic film substrate and an image-receiving layer formed on said substrate, wherein the image-receiving layer has an exposed surface with a surface roughness (JIS-B0601) of 0.15–0.60 $\mu$m in terms of arithmetic mean deviation Ra and 1.0–2.5 $\mu$m in terms of 10-point height of irregularities Rz.

15. The hot-melt transfer ink image-receiving sheet according to claim 14, wherein the image-receiving layer consists of an emulsion resin having a glass transfer temperature of 50–120° C.

16. The hot-melt transfer ink image-receiving sheet according to claim 15, wherein the emulsion resin is a homopolymer or copolymer of monomers selected from the group consisting of ethylene, styrene, vinyl chloride, vinyl acetate, acrylonitrile, and methyl methacrylate.

* * * * *

UNITED STATES PATENT AND TRADEMARK OFFICE

CERTIFICATE OF CORRECTION

PATENT NO. : 6,780,479 B2
DATED : August 24, 2004
INVENTOR(S) : Katsuoka et al.

It is certified that error appears in the above-identified patent and that said Letters Patent is hereby corrected as shown below:

Column 9,
Line 18, " " " should read -- Δ --.

Column 10,
Line 31, delete "is".

Signed and Sealed this

Seventh Day of June, 2005

JON W. DUDAS
*Director of the United States Patent and Trademark Office*